United States Patent [19]

Suzuki et al.

[11] 3,997,790

[45] Dec. 14, 1976

[54] APPARATUS FOR HEAT-FIXING A TONER IMAGE

[75] Inventors: Shigeru Suzuki; Yasumori Nagahara; Koichi Suzuki, all of Yokohama, Japan

[73] Assignee: Ricoh Co., Ltd., Japan

[22] Filed: July 8, 1975

[21] Appl. No.: 593,973

[30] Foreign Application Priority Data

July 12, 1974 Japan ..... 49-79992

[52] U.S. Cl. ..... 250/319

[51] Int. Cl.[2] ..... G03C 5/16

[58] Field of Search ..... 250/319, 316, 492

[56] References Cited

UNITED STATES PATENTS

| | | | |
|---|---|---|---|
| 2,891,165 | 6/1959 | Kuhrmeyer et al. | 250/319 |
| 2,927,210 | 3/1960 | O'Mara | 250/319 |
| 3,452,181 | 6/1969 | Stryjewski | 250/319 |
| 3,813,516 | 5/1974 | Kudsi et al. | 250/319 |

*Primary Examiner*—Alfred E. Smith
*Assistant Examiner*—B. C. Anderson
*Attorney, Agent, or Firm*—McGlew and Tuttle

[57] ABSTRACT

The apparatus is for heat-fixing a toner image onto a support sheet in which the fixing of toner image is effected through both infrared radiation and direct contact with a heated surface of fixing roller in succession. An endless belt, having a transparency for infrared and trained over a pair of rollers, is disposed within a heat insulating casing, an upper run of the belt defining a path of movement of a toner image bearing support sheet to be fixed. An infrared radiator is disposed beneath the upper run of belt while a reflecting plate is disposed at the opposite side of the belt from the radiator with respect to the path. A fixing roller is disposed downstream of the radiator along the path for completing the fixing.

6 Claims, 1 Drawing Figure

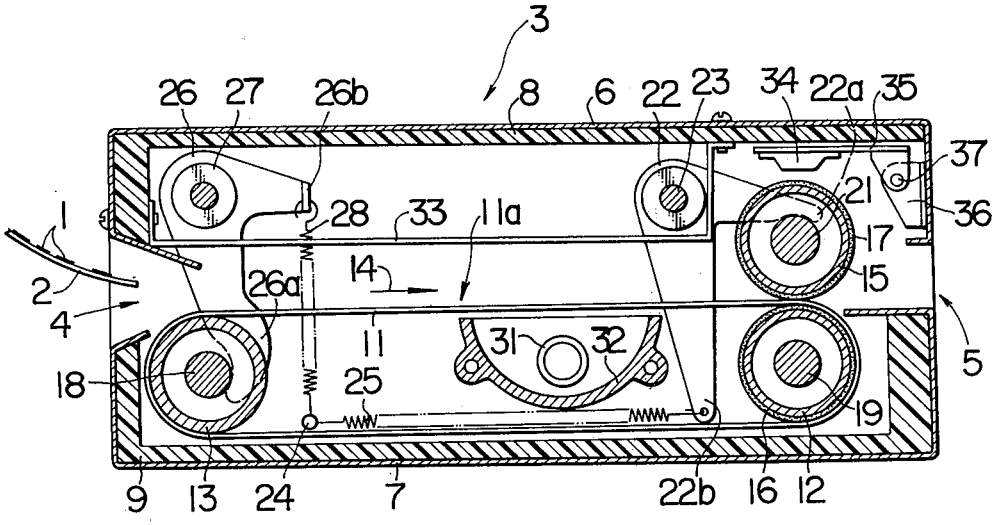
3
26
27
26b
8
6
22
23
34
22a
35
37
36
1
2
4
28
33
11a
21
17
15
14
26a
11
31
32
5
18
25
19
9
13
24
7
22b
16
12

APPARATUS FOR HEAT-FIXING A TONER IMAGE

BACKGROUND OF THE INVENTION

The invention relates to an apparatus for heating a toner image formed by electrophotography and fixing it onto a support therefor.

Various techniques have been proposed for fixing a toner image formed by electrophotography, including directly heating a support for the toner image between a pair of heated rollers, application of radiation heat to the support, or heating the support by placing it within a heated environment. Generally, they are advantageous in some respects but are disadvantageous in other respects. The requirements for a heating and fixing apparatus are minimized inflammability, the capability of raising the temperature to a level at which the fixing becomes possible within a short period, the accuracy of temperature control and the durability of parts used.

SUMMARY OF THE INVENTION

It is an object of the invention to provide an apparatus for heat-fixing a toner image which avoids drawbacks experienced with a conventional heating and fixing apparatus and satisfies the above requirements in a simple arrangement.

BRIEF DESCRIPTION OF THE DRAWING

The single drawing is an elevational section of the apparatus for heating and fixing toner image constructed in accordance with one embodiment of the invention.

DETAILED DESCRIPTION OF EMBODIMENT

Referring to the drawing, a toner image 1 is carried on a support 2, which is adapted to be inserted into a heating and fixing apparatus 3 at an inlet 4 and discharged through an outlet 5 subsequent to the fixing operation to be described later. The apparatus 3 includes a casing which is formed by casing halves 6, 7 having respective heat insulating linings 8, 9, along their inner surfaces. An endless belt 11 runs around a drive roller 12 and a guide roller 13 for movement in the direction indicated by an arrow 14, thus conveying the support to the right, as viewed in the drawing. A pressure roller 15 is disposed for abutting engagement against the drive roller 12. The peripheries of the drive roller 12 and the pressure roller 15 are lined with silicon rubber 16, 17, respectively, in order to prevent an offset of the toner image as the support 2 passes through the nip therebetween. Each of the rollers 12, 13 and 15 comprises a hollow structure having a reduced wall thickness to reduce its heat capacity, and is mounted on a respective 19, 18 or 21, which is journaled by a bearing (not shown) formed of a heat resistant resin to provide heat insulation from the casing halves 6, 7.

At its one end, the shaft 21 which carries the pressure roller 15 is engaged by the free end **22*a* of a short arm of a two-arm pressure member 22 which is fixedly mounted on an axle 23 which is journaled in the casing half 6. The member 22 has another long arm, the free end 22*b* of which is engaged with one end of a tension spring 25, the other end of which is anchored to a pin 24 secured to the lower casing half 7, thus urging the pressure roller 15 into abutting engagement with the drive roller 12. The other end of the shaft 21 is similarly urged by a corresponding pressure member (not shown) which is also secured to the axle 23. The shaft 18 which carries the guide roller 13 has its opposite ends journaled in elongate slots (not shown) which are formed to extend in the longitudinal direction in the sidewalls of the casing half 7. A pair of two-arm members 26 (only one being shown) have long arms 26*a*, the free ends of which bear against the shaft 18 so as to urge it to the left. Each arm member 26 is secured to an axle 27 which is journaled in the casing half 6, and also has a short arm, the free end of which is formed with a bent end 26*b* engaged by a tension spring 28. The spring 28 has its other end anchored to the pin 24, thereby urging each member 26 to rotate clockwise and hence urging the shaft 18 in a direction to maintain the belt 11** tensioned.

In the space between the upper and lower runs of the endless belt 11, an infrared lamp 31 associated with a reflector plate 32 is disposed to extend crosswise of the belt or in a direction perpendicular to the plane of the drawing. A reflector plate 33 is disposed above the conveying run **11*a* of the belt 11, and has its opposite ends secured to the casing half 6. A thermistor 34 for detecting the temperature of the roller 15 is disposed thereabove, and is fixedly mounted on the free end of a support plate 35, the other end of which is pivotally mounted at 37 on an attaching member 36 which is fixedly mounted on the casing half 6**.

The infrared lamp 31 is continuously energized until the temperature inside the apparatus 3 reaches 125° C, whereupon its energization is controlled in an on-and-off manner by the thermistor 34 so as to maintain the temperature of the pressure roller 15 at 130° C. The infrared lamp 31 is energized independently from the internal temperature when the support 2 is fed into the apparatus 3.

It is necessary that the endless belt 11 be formed of a high flexibility material capable of transmitting infrared ray therethrough and having a high heat resistance and mechanical strength. A suitable material for the belt may comprise a film of polyimide resin as a principal constituent, thermally bonded with a layer of Teflon FEP (trade name of the copolymer of tetrafluorethylene and propylene hexafluoride made by DuPont Co.) on the surface thereof. By constructing the belt 11 in this manner, the toner image 1 on the support 2 is melted during its travel on the belt 11 by the heat of radiation which is transmitted through the belt 11 and the support as well as the infrared energy reflected by the reflector plate 33, and hence is fixed to the support 2. The heated presssure roller 15 completes the fixing action, and subsequently the support 2 is discharged by the roller 15 through the outlet 5.

The use of the heat of radiation in heating and fixing the toner image is advantageous in reducing the time length required for the temperature to reach a desired level. Usually the heat of radiation is applied from the inside nearer the toner image, but this involves the risk of the support igniting as a result of its rushing into the heat source. Usually, such risk is prevented by causing the support for the toner image to be attracted to its associated conveying member by utilizing electrostatic means or negative pneumatic pressure. However, the use of electrostatic means in combination with the heat results in a loss of the electric charge while the negative pneumatic pressure produces a current of air which causes a temperature fall in the apparatus. In a further alternative arrangement, the infrared lamp is received in a covering formed of a refractory glass so that the support cannot rush into the heat source, but toner is attracted to the glass surface to intercept the infrared ray. In addition, if the support moves into contact with the glass surface, it becomes bonded therewith, thereby unfavorably preventing a smooth movement of the support.

In accordance with the invention, the infrared lamp 31 is disposed on the opposite side of the endless belt 11 from the support 2, and the heat of radiation therefrom is caused to be transmitted through the belt 11 for the purpose of fixing. This permits a fixing of the toner image while the support 2 is maintained substantially in a horizontal position against the belt 11 by gravity during its movement thereon, without utilizing attraction of the support 2 onto the belt 11, while minimizing a resulting reduction in the thermal efficiency, thus avoiding the above-mentioned risk without introducing a complex arrangement into the apparatus.

While the use of Teflon film for the belt is proposed, such film has an insufficient mechanical strength at a temperature above 150° C, which prevents its use as an endless belt. In addition, a Teflon film is too expensive for practical use. By contrast, a polyimide avoids all of these disadvantages.

Another difficulty experienced with the use of the heat of radiation is an incomplete fixing in the thin line and low density portions of the image as a result of an insufficient absorption of heat. By contrast, in the apparatus according to the invention, the conduction of heat from the belt 11 as well as the infrared atmosphere provide a satisfactory fixing of both thin lines and low density portions. This is accomplished by the use of the polyimide film for the belt, which provides an excellent flatness to increase the heat conduction from the belt 11.

Though polyimide can withstand a temperature of 260° C, because of the FEP layer thermally bonded to its surface to form the endless belt, the flatness will be degraded unless the belt is used at a temperature not higher than 200° C. In an experiment, a polyimide film having a thickness of 62.5 microns was passed over a 500 W infrared lamp with a speed of 100 mm/sec, and it was found that the temperature of the film, which latter was transparent and presented a light brown color, did not rise above 150° C as a result of absorbing heat, when its temperature was measured at a position immediately after lamp. Thus, there is no need of controlling the input to the heat source in order to provide the temperature control, thus allowing the apparatus to be inexpensively manufactured.

The location of the infrared lamp 31 beneath the belt 11 prevents the lamp 31 and the reflector 32 from being contaminated by scattered toner. The provision of the FEP layer of the surface of the belt 11 may cause a slight contamination of the latter, but because the resulting adhesion is very weak, the toner on the surface can be cleaned by adhesion to the back of the support 2. Nevertheless, the amount of toner thus adhering to the back of the support 2 is minimal, and smearing thereof is negligible.

It will be understood that reflector plate 32 associated with the lamp 31 should desirably focus the radiation from the lamp onto the endless belt 11. However, the higher the degree of focussing, the greater the risk of the support 2 assuming a high temperature and igniting. In an experiment, a 500 W infrared lamp was used in combination with a parabolic reflector to form a parallel beam having a width of 30 mm. When the support 2 was maintained at rest above the lamp 31 for thirty seconds, the support 2 only charred without igniting. The width to which the beam is focussed can be chosen in accordance with the length of time required for detecting the jamming of the support 2. In one example, it is found that the toner image 1 can be fixed to the support 2 using a feed rate of nearly 80 mm/second, without employing the pressure roller 15.

In another example, a fixing rate of 300mm/sec was achieved by using a pressure roller 15 which was heated to a temperature of 150° C and maintaining a contact pressure with the drive roller 12 of 100 g/cm or greater. However, when the heat of radiation is not applied to the support 2 during the fixing process, no fixing effect occurred.

If a heated silicon rubber roller is used alone to heat the support by direct contact therewith, its temperature must be closely controlled in a range of ±5° C. A further departure in the temperature will cause an offset of the image or cause the support to be entangled around the roller even though the fixing can be achieved. With the apparatus according to the invention, the temperature may be controlled for a greater range from 130° to 160° C, and if the same fixing rate is used, the optimum temperature can be reduced by more than 20° C. In addition, the pressure which must be applied to the support may be reduced to one-half the pressure which is required for directly fixing the image with only the heater roller, thus enabling an increased useful life of the pressure roller 15.

It will be noted that the upper casing half 6 associated with the reflector plate 33 can be made to be removable from the remainder in a region including a path of movement of support sheet 2 so as to facilitate an inspection or a corrective action in the event a jamming of the support 2 occurs within the apparatus.

What is claimed:

1. An apparatus for heat-fixing a toner image comprising, in combination, an endless belt having a transparency for infrared radiation and trained over rollers to form an upper run thereof for receiving thereon, and conveying, in a selected direction, a toner-image-bearing support sheet, having a toner-image-bearing surface facing upward and a back surface, facing downward to define a path of movement of the support sheet; means operable to move said belt in said direction; means disposed beneath said upper run of said belt and operable to radiate infrared energy through said upper run of said belt across said path of movement to the back surface of the support sheet; and reflecting means disposed on the side of said upper run of said belt opposite to that on which said radiating means is disposed, with respect to said path of movement, for reflecting infrared radiation received by said reflecting means toward said path of movement to the toner-image-bearing surface of the support sheet.

2. An apparatus according to claim 1 wherein said endless belt comprises a film of polyimide resin as a principal constituent, having its outer surface thermally bonded with a Teflon FEP layer.

3. An apparatus according to claim 1, further comprising a fixing roller, heated to a predetermined temperature and disposed downstream of said radiating means along said path of movement of the support sheet in rolling contact with said upper run of said belt, for completing the fixing of toner image onto the support sheet.

4. An apparatus according to claim 3 wherein said fixing roller has its periphery formed with a layer of silicon rubber.

5. An apparatus according to claim 1 wherein said casing comprises a upper and a lower halves which are removable from each other in a region including said path of movement of the support sheet.

6. An apparatus for heat-fixing a toner image comprising, in combination, a heat insulating casing having inlet and outlet ports for a toner-image-bearing support sheet; an endless belt, having a transparency for infrared radiation, disposed within said casing and trained over rollers to form an upper run thereof for receiving thereon and conveying a toner-image-bearing support sheet, having a toner-image-bearing surface facing upward and a back surface facing downward, to define a path of movement of the support sheet extending in the direction from said inlet port to said outlet port; means operable to move said belt in said direction; means disposed beneath said upper run of said belt for radiating infrared radiation through said upper run of said belt across said path of movement to the back surface of the support sheet; reflecting means disposed within said casing and on the side of said upper run of said belt opposite to that at which said radiating means is disposed, with respect to said path of movement, for reflecting infrared radiation received thereby toward said path of movement to the toner-image-bearing surface of the support sheet; and a fixing roller disposed within said casing downstream of said radiating means along said path of movement of the support sheet, in rolling contact with said upper run of said belt for completing the fixing of toner image onto the support sheet.

* * * * *